United States Patent [19]

Coates et al.

[11] Patent Number: 4,863,682

[45] Date of Patent: Sep. 5, 1989

[54] AUSTENITIC STAINLESS STEEL ALLOY

[75] Inventors: David J. Coates, Palo Alto; Gerald M. Gordon, Soquel; Alvin J. Jacobs, San Jose; David W. Sandusky, Los Gatos, all of Calif.

[73] Assignee: General Electric Company, San Jose, Calif.

[21] Appl. No.: 166,943

[22] Filed: Mar. 11, 1988

[51] Int. Cl.[4] ..... G21C 3/06

[52] U.S. Cl. ..... 376/457; 376/900; 420/56; 420/97

[58] Field of Search ..... 376/457, 900; 420/56, 420/97

[56] References Cited

U.S. PATENT DOCUMENTS

| | | | |
|---|---|---|---|
| 4,011,133 | 3/1977 | Bloom | 376/900 |
| 4,158,606 | 6/1979 | Bloom | 376/900 |
| 4,530,719 | 7/1985 | Johnson | 420/56 |
| 4,576,641 | 3/1986 | Bates | 420/56 |

*Primary Examiner*—Donald P. Walsh
*Attorney, Agent, or Firm*—Robert R. Schroeder

[57] ABSTRACT

A chromium-nickel austenitic stainless steel alloy composition, including specific proportions of carbon with a combination of niobium and tantalum.

10 Claims, No Drawings

AUSTENITIC STAINLESS STEEL ALLOY

FIELD OF THE INVENTION

This invention relates to austenitic stainless steel compositions for service in environments of high irradiation such as in the interior of a nuclear fission reactor. The invention is particularly concerned with an austenitic stainless steel alloy composition having both a high resistance to irradiation promoted corrosion and reduced long term irradiation induced radioactivity.

BACKGROUND OF THE INVENTION

Stainless steel alloys, especially those of high chromium-nickel type, are commonly used for components employed in nuclear fission reactors due to their well known good resistance to corrosive and other aggressive conditions. For instance, nuclear fuel, neutron absorbing control units, and neutron source holders are frequently clad or contained within a sheath or housing of stainless steel of Type 304 or similar alloy compositions. Many such components, including those mentioned, are located in and about the core of fissionable fuel of the nuclear reactor where the aggressive conditions such as high radiation and temperature are the most rigorous and debilitating.

Solution or mill annealed stainless steels are generally considered to be essentially immune to intergranular stress corrosion cracking, among other sources of deterioration and in turn, failure. However, stainless steels have been found to degrade and fail due to intergranular stress corrosion cracking following exposure to high irradiation such as typically encountered in service within and about the core of fissionable fuel of water cooled nuclear fission reactors. Such irradiation related intergranular stress corrosion cracking failures have occurred notwithstanding the stainless steel metal having been in the so-called solution or mill annealed condition, namely having been treated by heating up to within a range of typically about 1,850° to about 2,050° F., then rapidly cooled as a means of solutionizing carbides and inhibiting their nucleation and precipitation out into grain boundaries.

Accordingly, it is theorized that high levels of irradiation resulting from a concentrated field or extensive exposure, or both, are a significantly contributing cause of such degradation of stainless steel, due among other possible factors to the irradiation promoting segregation of the impurities therein.

Efforts have been made to mitigate intergranular stress corrosion cracking of stainless steels which have not been desensitized by solution or mill annealing, or irradiated, including the development of "stabilized" alloys. For example, alloys have been developed containing a variety of alloying elements which are intended to form stable carbides. Such stabilizing carbides should resist solutionizing at annealing temperatures of at least 1900° F. whereby the carbon is held so that the subsequent formation of chromium carbide upon exposure to high temperatures is prevented. Included among the alloying elements proposed are titanium, niobium and tantalum. An example of one type of such a stainless steel alloy is marketed under the designation of Type 348. The *Metals Handbook,* Ninth Ed., Vol. 3, page 5, American Society for Metals, 1980 gives the alloy composition for Type 348 in weight percent as follows:

| C | Mn | Si | Cr | Ni | P | S | Cu | Nb + Ta |
|---|---|---|---|---|---|---|---|---|
| 0.08 max. | 2.00 max. | 1.00 max. | 17.0–19.0 | 9.0–13.0 | 0.045 max. | 0.03 max. | 0.2 max. | 10 × % C min. |

SUMMARY OF THE INVENTION

This invention comprises a stainless steel alloy composition having specific ratios of alloying elements for service where exposed to irradiation. The austenitic stainless steel alloy composition provides resistance to the degrading effects of the irradiation, and is of reduced long term irradiation induced radioactivity.

OBJECTS OF THE INVENTION

It is a primary object of this invention to provide an austenitic stainless steel alloy composition having effective resistance to the deleterious effects attributable to prolonged exposure to high levels of radiation.

It is also an object of this invention to provide an austenitic stainless steel alloy composition which essentially maintains its physical and chemical integrity when subjected to high levels of irradiation over long periods.

It is a further object of this invention to provide an austenitic stainless steel alloy composition which provides effective resistance to irradiation promoted intergranular stress corrosion cracking.

It is a still further object of this invention to provide an austenitic stainless steel alloy composition which minimizes the long term imposed radioactivity resulting from exposure to extensive high levels of irradiation in service.

It is an additional object of this invention to provide an austenitic stainless steel alloy composition which exhibits low radiation emissions following its irradiation whereby it can be disposed of at low costs.

DETAILED DESCRIPTION OF THE INVENTION

This invention is particularly directed to a potential deficiency of susceptibility to irradiation degradation which may be encountered with chromium-nickel austenitic stainless steels comprising Type 304 and related high chromium-nickel alloys such as listed in Tables 5-4 on pages 5-12 and 5-13 of the 1958 edition of the *Engineering Materials Handbook,* edited by C. L. Mantell. These alloys comprise austenitic stainless steels of about 18 to 20 percent weight of chromium and about 9 to 11 percent weight of nickel, with up to a maximum of about 2 percent weight of manganese, and the balance iron with incidental impurities.

This invention comprises a modified Type 304 austenitic stainless steel and a specific alloy composition including precise ratios of added alloying ingredients, as well as given limits on certain components of the standard austenitic stainless steel alloy.

The alloy composition of this invention accordingly comprises the basic iron, chromium, nickel and manganese with the chromium in a percent weight of about 18 to 20, nickel in a percent weight of about 9 to 11 and manganese in a percent weight of about 1.5 to 2, with the balance iron and incidental impurities, except for the following fundamental alloying ingredients and requirements. The carbon component of the alloy is limited to a percent weight of 0.02 to about 0.04 percent weight. Also, a combination of niobium and tantalum is included together in a total of a minimum of 14 times the carbon percent weight, up to maximum of about 0.65 percent weight of the overall alloy, and with the niobium of the combination limited to a maximum of about 0.25 percent weight of the overall alloy. Thus, the tantalum of the combination can range up to about 0.4 percent weight of the overall alloy.

Aside from the carbon content and the combination of niobium and tantalum in their given fundamental proportions, the other components of the alloy of this invention, including some incidental ingredients, comprises the following in approximate percent weight:

| | |
|---|---|
| Iron | Balance |
| Chromium | 18.0–20.0 |
| Nickel | 9.0–11.0 |
| Manganese | 1.5–2.0 |
| Phosphorus | 0.005 maximum |
| Sulfur | 0.004 maximum |
| Silicon | 0.03 maximum |
| Nitrogen | 0.03 maximum |
| Aluminum | 0.03 maximum |
| Calcium | 0.01 maximum |
| Boron | 0.003 maximum |
| Cobalt | 0.05 maximum |

The foregoing specific austenitic stainless steel alloy composition, among other attributes, provides a high degree of resistance to stress corrosion cracking regardless of exposure to irradiation of high levels and/or over prolonged period, without incurring long term induced radioactivity. As such, the alloy composition of this invention is well suited for use in the manufacture of various components for service within and about nuclear fission reactors whereby it will retain its integrity and effectively perform over long periods of service regardless of the irradiation conditions. Moreover, the alloy composition of this invention additionally minimizes irradiation induced long term radioactivity whereby the safety and cost requirements for its disposal following termination of service are reduced, and of greatly shortened period.

The following comprises an example of a preferred austenitic stainless steel alloy composition of this invention.

| Alloy Ingredient | Percent Weight |
|---|---|
| Carbon | 0.033 |
| Chromium | 19.49 |
| Nickel | 9.34 |
| Tantalum | 0.40 |
| Niobium | 0.02 |
| Sulfur | 0.003 |
| Phosphorus | 0.001 |
| Nitrogen | 0.003 |
| Silicon | 0.03 |
| Iron | Balance |
| Physical Properties | |
| Yield, KSI | 40.0–47.0 |
| Elongation, % | 48–52 |
| Grain Size (ASTM) | 9.5 |
| Hardness. $R_B$ | |

What is claimed is:

1. A stainless steel alloy composition for service exposed to irradiation, having resistance to irradiation promoted stress corrosion cracking and reduced long term irradiation induced radioactivity, consisting of a low carbon content austenitic stainless steel alloy composition comprising about 18 to 20 percent weight of chromium, about 9 to 11 percent weight of nickel, about 1.5 to 2 percent weight of manganese, a maximum of about 0.04 percent weight of carbon, a minimum of about 14 times of the carbon percent weight contents of a combination of niobium and tantalum together with the niobium of the combination limited to about 0.25 percent weight of the alloy composition, and the balance of the composition comprising iron with only incidental impurities.

2. The stainless steel composition of claim 1, wherein the alloy composition contains carbon within the range of about 0.02 to about 0.04 percent weight.

3. The stainless steel composition of claim 1, wherein the alloy composition contains tantalum in amounts up to about 0.4 percent weight.

4. The stainless steel composition of claim 1, wherein the alloy composition contains a combination of niobium and tantalum together in amounts of at least about 0.28 percent weight.

5. A stainless steel alloy composition for service exposed to irradiation, having resistance to irradiation promoted stress corrosion cracking and reduced long term irradiation induced radioactivity, consisting of a low carbon content austenitic stainless steel alloy composition comprising about 18 to 20 percent weight of chromium, about 9 to 11 percent weight of nickel, about 1.5 to 2 percent weight manganese, a maximum of about 0.04 percent weight of carbon, a minimum of about 14 times of the carbon percent weight contents of a combination of niobium and tantalum together with the niobium of the combination limited to no more than about 0.25 percent weight of the alloy composition, a maximum of about 0.005 percent weight of phosphorus, a maximum of about 0.004 percent weight of sulfur, a maximum of about 0.03 percent weight of silicon, a maximum of about 0.03 percent weight of nitrogen, a maximum of about 0.03 percent weight of aluminum, a maximum of about 0.01 percent weight of calcium, a maximum of about 0.003 percent weight of boron, a maximum of about 0.05 percent weight of cobalt, and the balance of the alloy composition comprising iron with incidental impurities.

6. The stainless steel composition of claim 5, wherein the alloy composition contains carbon within the range of about 0.02 to about 0.04 percent weight.

7. The stainless steel composition of claim 5, wherein the alloy composition contains tantalum in amounts up to about 0.4 percent weight.

8. The stainless steel composition of claim 5, wherein the alloy composition contains a combination of niobium and tantalum together in amounts of at least about 0.28 percent weight.

9. The stainless steel composition of claim 5, wherein the alloy composition contains a combination of niobium and tantalum together in a maximum amount of about 0.65 percent weight, with the niobium in a maximum amount of about 0.25 percent weight.

10. A stainless steel alloy composition for service exposed to irradiation, having resistance to irradiation promoted stress corrosion cracking and reduced long term irradiation induced radioactivity, consisting of a low carbon content austenitic stainless steel alloy composition comprising about 18 to 20 percent weight of chromium, about 9 to 11 percent weight of nickel, about 1.5 to 2 percent weight of manganese, about 0.02 to about 0.04 percent weight of carbon, a minimum of about 14 times of the carbon percent weight contents of a combination of niobium and tantalum together and a maximum amount of about 0.65 percent weight of said combined niobium and tantalum with the niobium in a maximum amount of about 0.25 percent weight of the alloy composition, a maximum of about 0.005 percent weight of phosphorus, a maximum of 0.004 percent weight of sulfur, a maximum of about 0.03 percent weight of silicon, a maximum of about 0.03 percent weight of nitrogen, a maximum of about 0.03 percent weight of aluminum, a maximum of about 0.01 percent weight of calcium, a maximum of about 0.003 percent weight of boron, a maximum of about 0.05 percent weight of cobalt, and the balance of the alloy composition comprising iron with incidental impurities.

* * * * *